US008794311B2

(12) United States Patent
Lauderdale

(10) Patent No.: US 8,794,311 B2
(45) **Date of Patent: *Aug. 5, 2014**

(54) SUBTERRANEAN TOOL WITH SHOCK ABSORBING SHEAR RELEASE

(75) Inventor: Donald P. Lauderdale, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 237 days.

This patent is subject to a terminal disclaimer.

(21) Appl. No.: 13/330,980

(22) Filed: Dec. 20, 2011

(65) Prior Publication Data

US 2013/0153203 A1 Jun. 20, 2013

(51) Int. Cl.
*E21B 23/00* (2006.01)

(52) U.S. Cl.
USPC ..... 166/181; 166/123

(58) Field of Classification Search
USPC ..... 166/55, 237, 377, 378, 360, 181, 120, 166/125, 123; 175/321
See application file for complete search history.

(56) References Cited

U.S. PATENT DOCUMENTS

| | | | | |
|---|---|---|---|---|
| 4,516,634 | A * | 5/1985 | Pitts | 166/120 |
| 6,053,262 | A | 4/2000 | Ferguson et al. | |
| 6,152,219 | A * | 11/2000 | Vick et al. | 166/117 |
| 6,367,552 | B1 | 4/2002 | Scott et al. | |
| 7,426,964 | B2 | 9/2008 | Lynde et al. | |
| 7,779,907 | B2 | 8/2010 | Wagner et al. | |
| 2010/0206580 | A1 * | 8/2010 | Tessari et al. | 166/377 |
| 2011/0056678 | A1 | 3/2011 | O'Brien | |

* cited by examiner

*Primary Examiner* — David Andrews
*Assistant Examiner* — Taras P Bemko
(74) *Attorney, Agent, or Firm* — Steve Rosenblatt

(57) ABSTRACT

A subterranean tool can be actuated with one or more control lines for a hydraulic release. It can further be actuated with a shear release after a lockout feature for the shear release is defeated. The shear release features a lock that limits relative movement so that a shear member can be defeated but without a release. A dog limits relative movement in a wider groove where dog movement in the groove allows a shock absorbing feature to act to cushion the release as the shear member breaks. The relative movement is reversed to let a retaining ring drop out of the way into a groove that comes into alignment with it. The relative movement is reversed again to pull a sleeve out from under gripping collets that have previously failed to release and the tool releases from that point on the same way as the control line actuated release.

17 Claims, 7 Drawing Sheets

SUBTERRANEAN TOOL WITH SHOCK ABSORBING SHEAR RELEASE

FIELD OF THE INVENTION

The field of the invention is subterranean tools and more particularly tools that release hydraulically with a backup protected shear release that further provides a soft release to avoid damaging components in the shear release alternative.

BACKGROUND OF THE INVENTION

Frequently an upper string needs to be anchored to a packer to support tools on the string such as an electric submersible pump. Such tools block access below the packer and on some occasions need to be removed from the wellbore for maintenance. Typically the packer has an associated barrier valve that needs to be closed when the upper completion is released from the packer. To hold the upper completion to the packer generally in a polished bore receptacle an anchor or disconnect is used. There are several concerns with such applications that are run in together attached to the packer. There is the concern of an unintentional disconnection such as when setting the packer with internal pressure or when trying to get the assembly to advance to the desired location. In tools that disconnect with an applied force to break a shear pin there is also a concern that the stretch in the string at the time of release would provide a violent ricochet and damage some of the parts such as the actuator attached to the packer barrier valve.

Tools that release with the breaking of a shear pin or the flattening of a stack of Belleville washers are known for example in U.S. Pat. No. 6,053,262. Some tools replace collets and shear pins in a disconnect to gain full circumferential support in a locked position as in U.S. Pat. No. 7,426,964.

Devices have been used to reduce shock in the context of dropped tools that have a crushable nose as in U.S. Pat. No. 7,779,907 while others allow a controlled release of parts in a manner to avoid damage to the parts using a multi-dimensional pin in a bore that allows pulling to get a surface signal of landing in a casing collar before sufficient pin movement in the bore to allow a reduction of applied surface force before any release of components. This device is illustrated in US Publication 2011/0056678. U.S. Pat. No. 6,367,552 shows a travel joint that is held together until applied force meters fluid through an orifice to then permit enough relative movement to unlock the travel joint components for relative movement.

What is lacking in these tools is options for the release that also address in the space limitations of subterranean tools a way to control which release mode is operative at any given time and the ability to minimize damage to associated components when the release would otherwise be violent such as breaking one or more shear pins with a release force applied to a string. The present invention provides hydraulic release or actuation as the primary mode of operation. When operating in this mode the shear release mechanism can be protected from stress from forces applied to the string. Optionally the locking feature that protects the shear device can be disabled for normal operation of the tool with the packer set. If for any reason the manipulation of hydraulic pressure in the control line to the tool does not permit a release by a simple pull on the string a shear device is broken but with travel limited so that disconnection does not occur. Instead a shock absorbing member provides the needed relative movement for defeating the shear member while absorbing the shock of the release. Reversing the relative movement then releases fully two adjacent components so that collets can be undermined for a low force separation that will not harm the barrier valve actuation system that is still engaged to the anchor or disconnect as the upper sting comes out of the hole. While one application is described those skilled in the art will appreciate that other tools can benefit from the described designs in the description of the preferred embodiment and the associated drawings while recognizing that the full scope of the invention is to be determined from the appended claims.

SUMMARY OF THE INVENTION

A subterranean tool can be actuated with one or more control lines for a hydraulic release. It can further be actuated with a shear release after a lockout feature for the shear release is defeated. The shear release features a lock that limits relative movement so that a shear member can be defeated but without a release. What limits the relative movement is a dog in a wider groove where dog movement in the groove allows a shock absorbing feature to act to cushion the release as the shear member breaks. The shock absorber can be a crushable ring of a soft metal. The relative movement is reversed to let a retaining ring drop out of the way into a groove that comes into alignment with it. The relative movement is reversed again to pull a sleeve out from under gripping collets that have previously failed to release and the tool releases from that point on the same way as the control line actuated release.

DETAILED DESCRIPTION OF THE PREFERRED EMBODIMENT

Figure 1A:
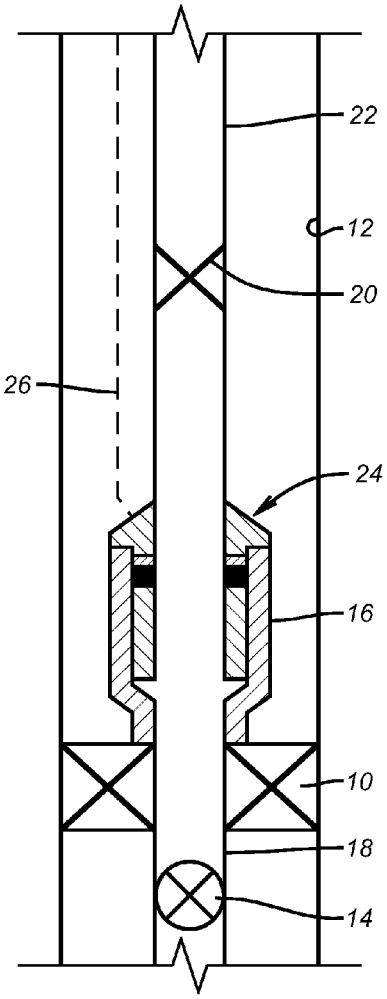
FIG. 1A is a schematic view of the anchor connected to a packer with the packer in the set position.
Figure 1B:
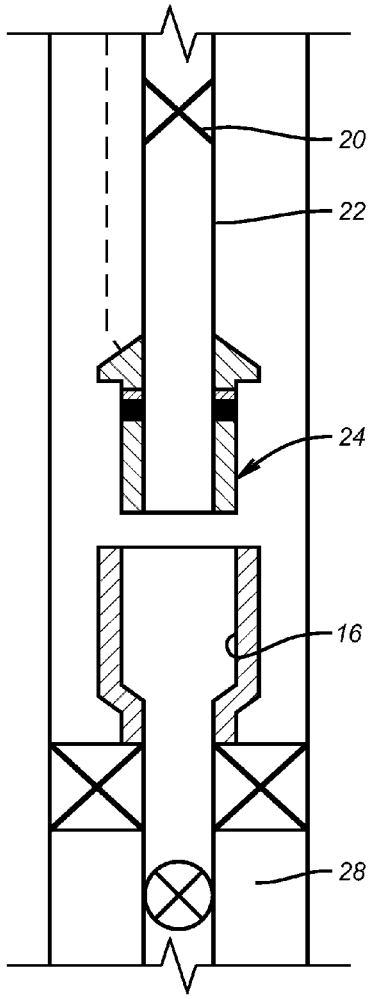
FIG. 1B is the view of FIG. 1 showing the upper string with any attached tool coming out as the anchor is released.
Figure 2:
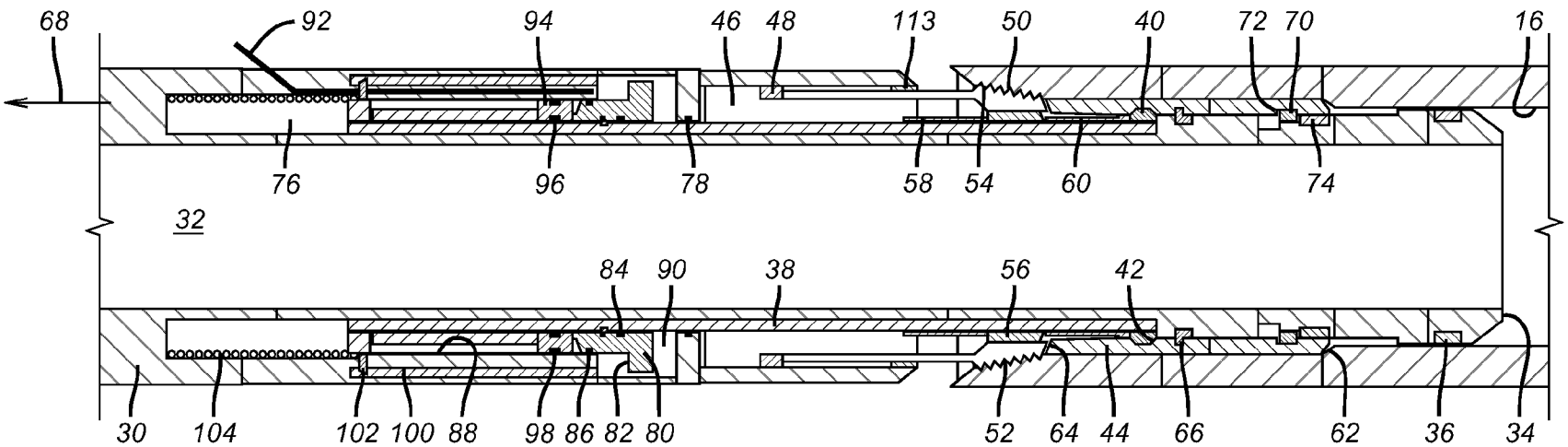
FIG. 2 is a detailed section view of the anchor in the run in position.

Referring to FIGS. 1 and 2, a packer 10 is schematically illustrated in the set position against a wellbore wall or surrounding tubular 12. A barrier valve or formation isolation valve 14 is located below the packer 10 and a polished bore receptacle 16 is above the packer mandrel 18. A tool such as an electric submersible pump 20 is supported by string 22. The preferred embodiment of the present invention is an anchor 24 that is secured to the polished bore receptacle 16 and selectively released in one of the described modes below with operation of the hydraulic system shown in this view schematically as a control line 26. FIG. 2 shows that separation can be accomplished so that the tool 20 can come out with the string 22 while at the same time the formation isolation valve 14 is closed to isolate zone 28 as a result of the polished bore receptacle 16 being open when the tool 20 is removed. Although the invention will be described in the context of the preferred embodiment of an anchor, that is only by way of example as other tools can benefit from the described systems below and the manner that they are assembled and operated.

The details of the anchor assembly 24 are better seen in FIG. 2. Mandrel 30 has a through passage 32 and a lower end 34 with an external seal 36 against the polished bore receptacle 16. An inner sleeve 38 supports one or more dogs 40 that extend into a groove 42 in an outer sleeve 44. Said inner sleeve 38 and said outer sleeve 44 comprise the movable member. Mandrel 30 has an outer wall that defines an annular space 46 in which sits a collet ring 48 with a series of extending fingers capped by heads 50 that have a grip surface 52 that engages grip surface 54 at the upper end of the polished bore receptacle 16. Ring 48 with heads 50, having the grip surface 52, on the end of the fingers are considered the final controlled element. For run in a support dog or dogs 56 is axially sandwiched between rings 58 and 60. Rings 58 and 60 are mechanically connected to mandrel 30. Ring 58 can slide with inner sleeve 38 and ring 60 is secured to outer sleeve 44. Outer sleeve 44 is held in position at end 62 by the polished bore receptacle 16 and at end 64 by heads 50 that are held fixed to the grip surface 54 of the polished bore receptacle 16 by virtue of the underlying support collet or ring 56 that is in turn supported by inner sleeve 38. A shear ring or some other breakable member 66 extends between mandrel 30 and outer sleeve 44. In the FIG. 2 position mandrel 30 cannot move up in the direction of arrow 68 because the dogs 40 are supported in groove 42 of the outer sleeve 44 by the inner sleeve 38. Ring 70 sits in groove 72 that is axially wider than ring 70. A shock absorber 74 is adjacent ring 70. The purpose of ring 70 in wider groove 72 is to allow enough axial mandrel 30 movement when the dogs 40 are allowed out of groove 42 by initial sliding of inner sleeve 38 and an upward pull on the mandrel 30 in the direction of arrow 68 as will be explained more fully below.

An upper chamber 76 is separated from annular space 46 by a seal 78. Primary piston 80 is preferably l-shaped and has a travel stop surface 82 and opposed seals 84 and 86. Seal 86 rides in bore 88 and seal 84 rides on inner sleeve 38 to define a sealed sub-chamber 90 with seal 78. A control line 92 is used to selectively pressurize and to remove pressure from sub-chamber 90. A secondary piston 94 has seals 96 and 98 in bore 88. Seal 98 is against the bore 88 and seal 96 is against the inner sleeve 38. Both pistons 80 and 94 are annular pistons. A return rod 100 is held in the position shown during run in against the force of a spring 104 by a latch 102. As will be explained below, release of the latch 102 will allow the spring 104 to push the return rod 100 against the primary piston 80 to a point where seal 86 will come out of bore 88 to effectively disable the piston 80 from moving in response to another pressure application in the control line 92.

Figure 3A:
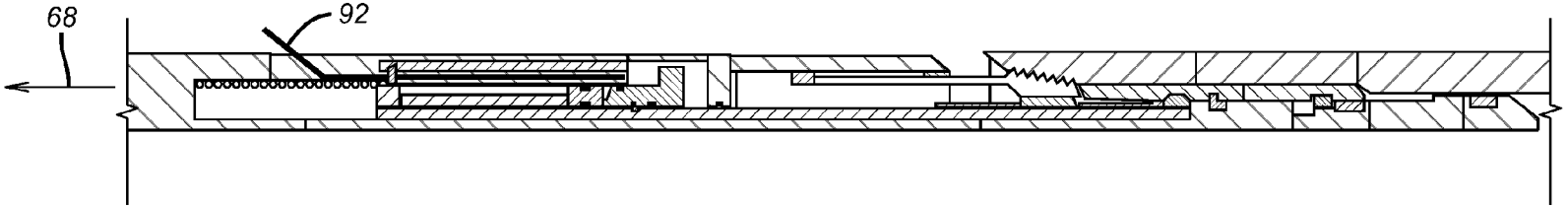
FIG. 3A shows applied control line pressure to the view of FIG. 2 and before parts start moving.

The basic components of the apparatus now having been described the normal hydraulic release feature will now be described in more detail. FIG. 3A shows the parts in the same run in position of FIG. 2 and now in half section for greater clarity. Pressure is applied to control line 92 in FIG. 3B. This makes chamber 90 volume increase as primary and secondary pistons 80 and 94 move in tandem in the direction of arrow 68. Secondary piston 94 shoulders against the inner sleeve 38 and makes inner sleeve 38 also move in the direction of arrow 68. Such movement of inner sleeve 38 takes inner sleeve 38 out from under the dogs 40 allowing the dogs to fall into groove 106 now made available to the dogs 40 by the movement of the inner sleeve 38. This movement is essentially the unlocking of a lock that now frees the mandrel 30 to move relative to the outer sleeve 44 but such movement does not take place merely by adding pressure to control line 92. Rather a shear release that comprises breaking ring 66 is enabled in FIG. 3B but it does not occur. As long as pressure is held in control line 92 the parts will hold the FIG. 3B position. Included in the FIG. 3B movements is the movement of the latch 102 to a position to allow the spring 104 to move the return rod 100 when pressure in line 92 is relieved from the surface. It is also worth noting that the heads 50 continue to be supported for a grip onto the polished bore receptacle 16 by virtue of the fact that the position of the collet or ring support 56 has not shifted despite the axial movement of the inner sleeve 38. In FIG. 3C the pressure in the control line 92 is released and the spring 104 takes the rod 100 against surface 82 of piston 80 so that piston 80 bottoms out on stop 106 as seal 86 comes out of bore 88. The pushing back of piston 80 takes piston 94 with it because the two are liquid locked in bore 88 and move in tandem. Optionally chamber 76 can be open to annulus pressure that can assist in the return motion of pistons 80 and 94. Again support 56 has not moved in FIG. 3C and the grip to the polished bore receptacle 16 is still maintained.

Referring now to FIG. 4A the pressure is again applied to control line 92. This time piston 80 is unaffected by this pressure as one of its seals 86 is out of bore 88. Now pressure just drives piston 94 that again takes with it the inner sleeve 38 but this time the motion is not curtailed by stop surface 82 now held back by rod 100 using spring 104. Now piston 94 takes inner sleeve 38 in the direction of arrow 68 a distance great enough to allow the collets or ring support 56 to fall against the mandrel 30 and remove the supports for the heads 50 so that an upward pull on the mandrel 30 in the direction of arrow 68 as shown by FIG. 4B will allow the heads 50 to come away from grip surface 54 and the mandrel 30 will now exit the polished bore receptacle 16.

Figure 3B:
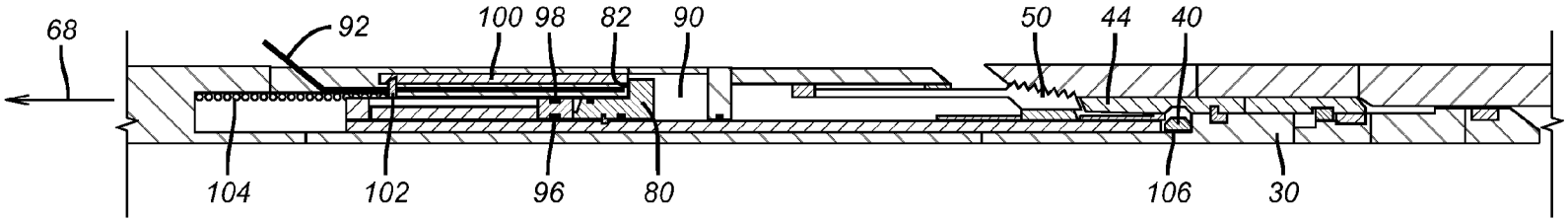
FIG. 3B is the view of FIG. 3A after the pistons have shifted left to unsupport the locking dogs.
Figure 3C:
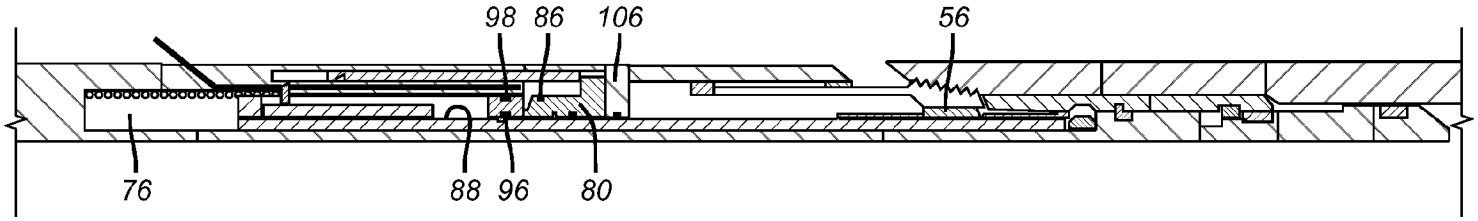
FIG. 3C is the view of FIG. 3B with the pistons shifted right to disable the primary piston as a result of removal of control line pressure, which fully disables the lockout for the shear ring and positions the secondary piston to allow a release on subsequent pressure applied to the control line.
Figure 4A:
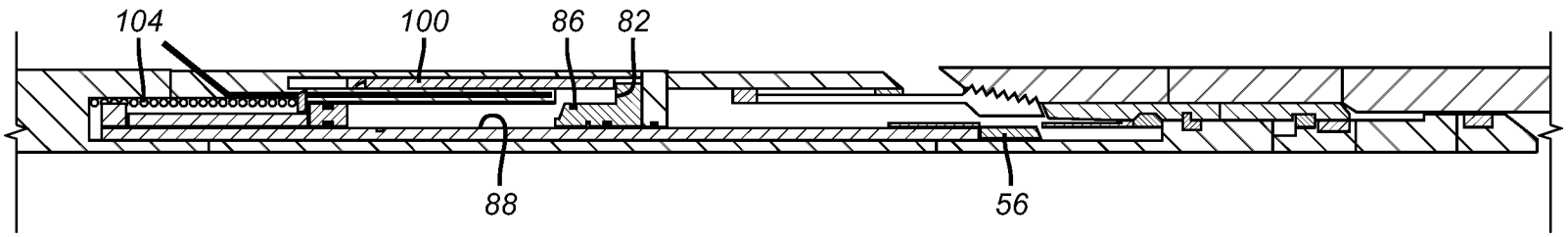
FIG. 4A shows the application of hydraulic pressure to unsupport the collets for a normal hydraulic release.
Figure 4B:
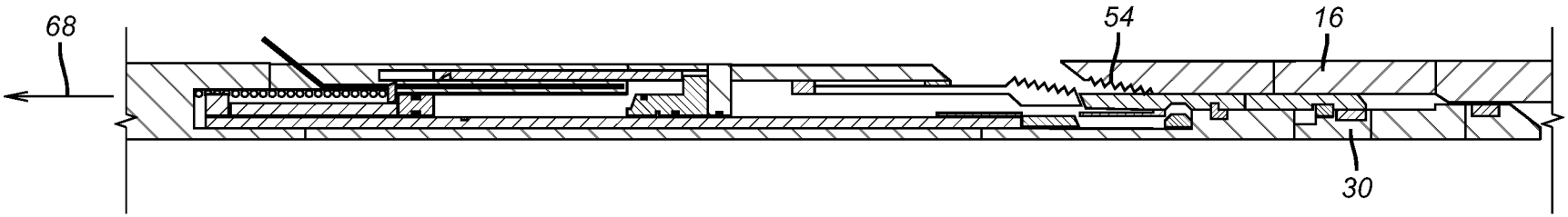
FIG. 4B is the view of FIG. 4A showing a pulling force applied to get the components to release.
Figure 5A:
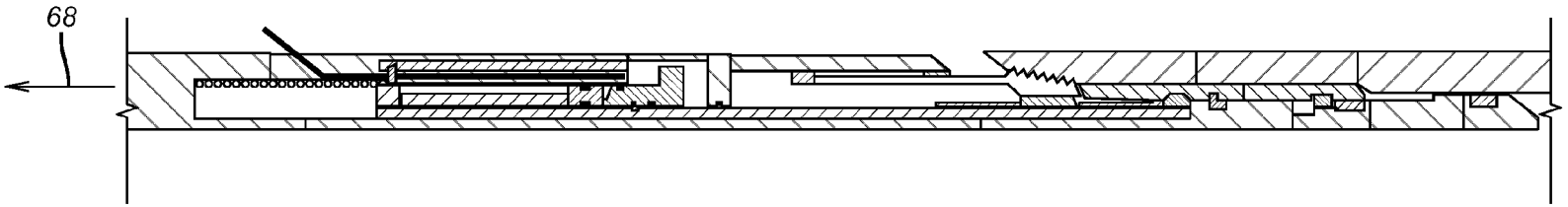
FIGS. 5A-5C show again the movements in FIGS. 3A-3C but this time the collets are still supported in FIG. 5C and a shear release becomes necessary.
Figure 5B:
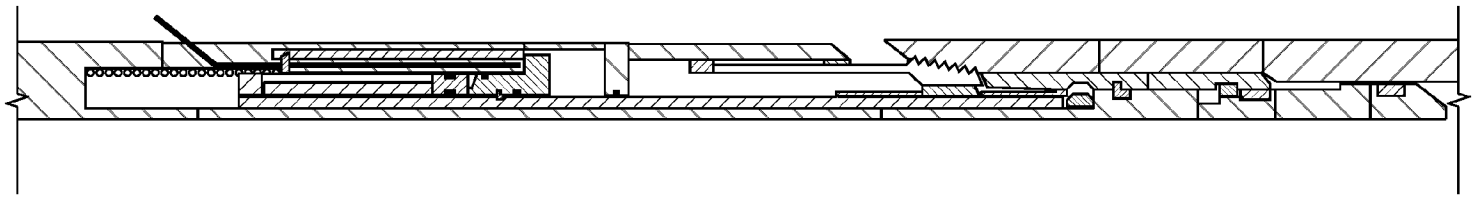
Figure 5C:
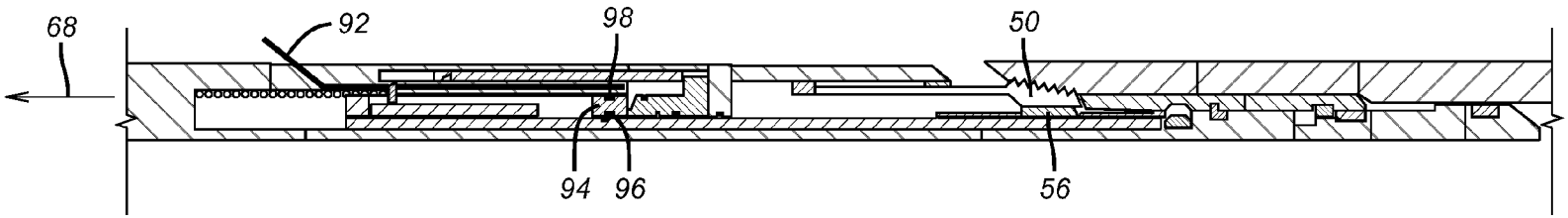

FIGS. 5A-5C are essentially the same as FIGS. 3A-3C except that now when pressure is applied to control line 92 for a second time the piston 94 fails to move the inner sleeve 38 to the point where the support 56 is undermined by the sliding of inner sleeve 38 such as happened in FIG. 4A. This can happen for example if one or both of the seals 96 or 98 on piston 94 fail. As a result a mere pulling on the mandrel 30 in the direction of arrow will not work as the heads 50 continue to be firmly held against grip surface 54 of the polished bore receptacle 16. When this happens, the release with hydraulic pressure into control line 92 is inoperative and the backup mode of release with a tension force on mandrel 30 has to be deployed.

Figure 6A:
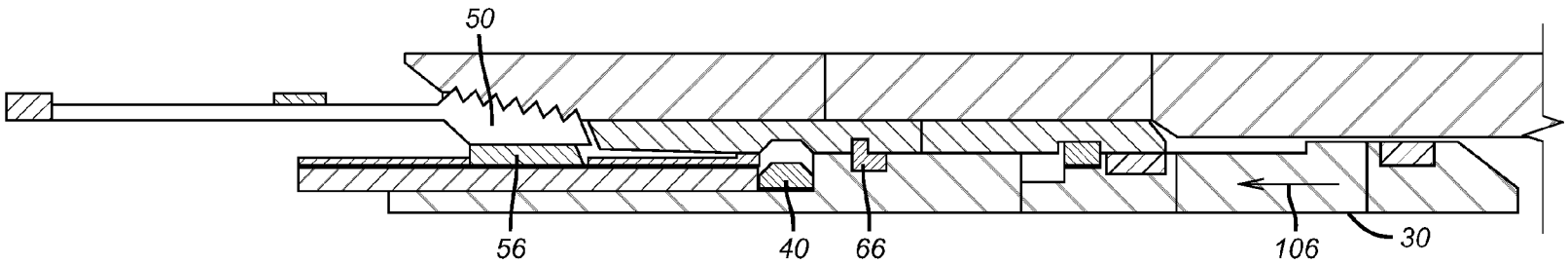
FIG. 6A shows an applied force after a failure of the hydraulic release as a way of initiating the shear release.
Figure 6B:
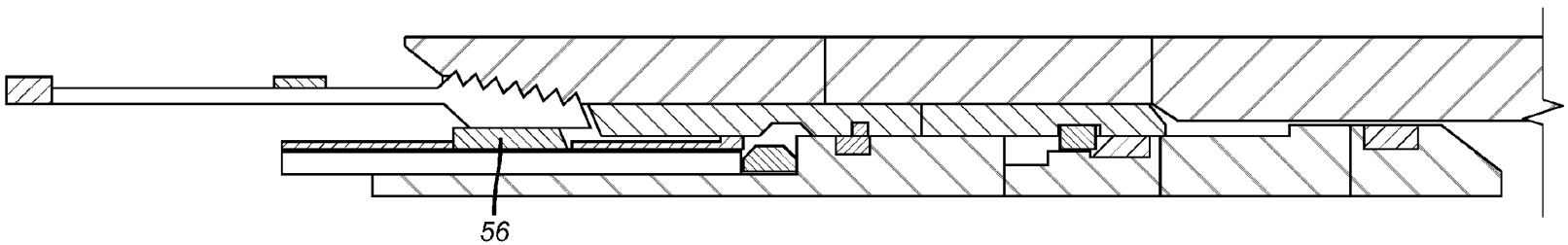
FIG. 6B shows the shear ring broken due to relative movement but with the collets still supported and the shock absorber taking the shock of the breaking of the shear ring within the limits of travel of a lock ring in a lock ring groove.

Referring to FIG. 6A ring 70 is in groove 72 that is shown as axially longer than ring 70. At this time the dogs 40 have dropped out of groove 42 due to earlier sliding action of inner sleeve 38. The shear ring 66 is intact. Because ring 70 is narrower than groove 72 a pull on the mandrel 30 with heads 50 secured to the polished bore receptacle 16 will result in the breaking of the shear ring 66 as ring 70 moves from one side of groove 72 to the other. The placement of the shock absorber 62 is such that the mandrel 30 to keep moving in direction of arrow 106 has to operate the shock absorber. In essence the mandrel 30 continues to be retained in the polished bore receptacle 16 after ring 66 is sheared and as the shock absorber 62 is operating. The shock absorber 62 can be in the form of a soft ring preferably metallic that is crushed with the relative movement of the mandrel 30 with respect to the polished bore receptacle 16. The shock absorber 62 can be a stack of Belleville washers, a chamber forcing fluid out through an orifice, some other kind of spring, for example and not by way of limitation. The point is that the initial mandrel 30 movement that broke the shear ring 66 and activated the shock absorber 62 will not as yet release mandrel 30 from receptacle 16 because the heads 50 are still supported by support ring or collet 56, but it will allow the released force from the breaking of the shear ring 66 to be dissipated by the shock absorber 62 so that there is no slingshot effect from the breaking of the shear ring 66. Note that support 56 is still under the heads 50 in FIG. 6B.

Figure 6C:
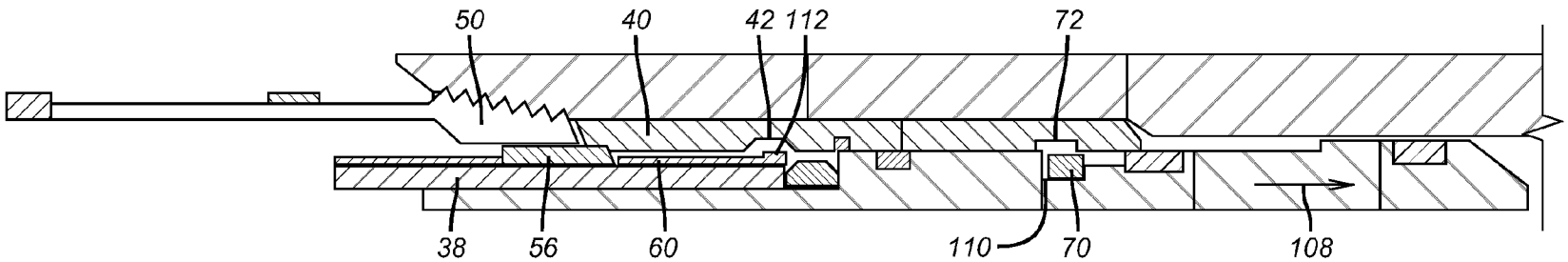
FIG. 6C shows a reversal of relative movement to let the lock ring drop into a groove to free up the latch body from the release sleeve.
Figure 6D:
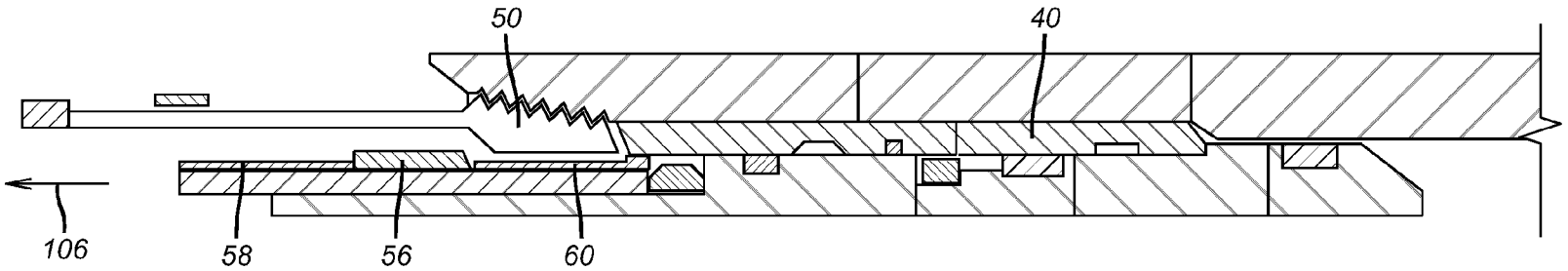
FIG. 6D shows an applied tensile force to start the separation from the polished bore receptacle.
Figure 6E:
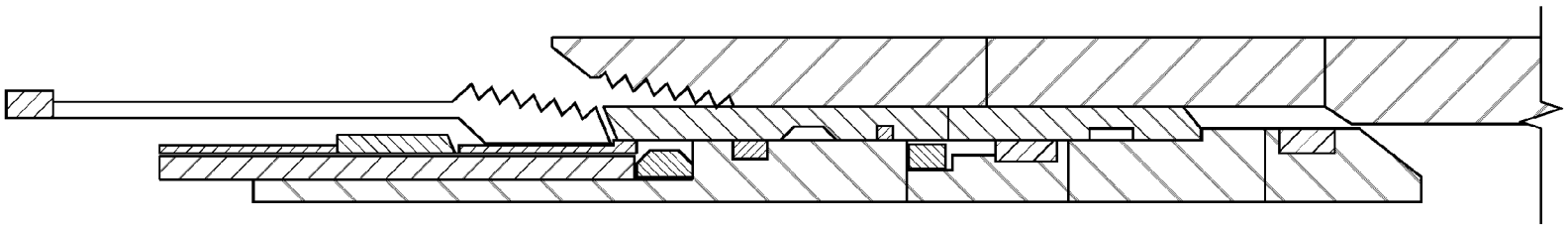
FIG. 6E shows further movement beyond the position in FIG. 6D toward a separation.
Figure 7:
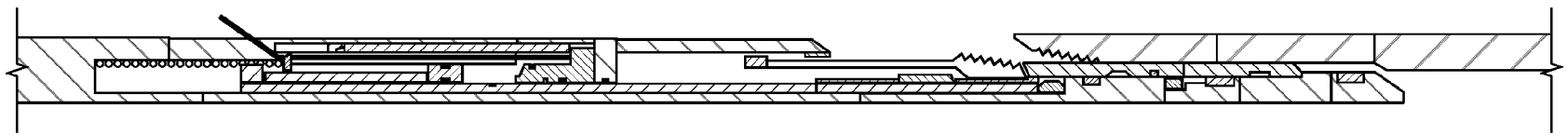
FIG. 7 is the view of FIG. 6E showing more of the tool in the same position as the tool is shown in FIG. 6E.

When the movement of the mandrel 30 is reversed to the direction of arrow 108 as in FIG. 6C the lock ring 70 can fall out of groove 72 and fall into groove 110 that presents itself in alignment due to the setting down weight on mandrel 30 which moved mandrel 30 in the direction of arrow 108 until travel stop 113 is engaged by mandrel 30. With ring 70 now in groove 110 the mandrel 30 can be picked up again in the direction of arrow 106. Note that at this time the ring 60 is not retained by outer sleeve 40 because as shown in FIG. 6C groove 42 is over the heads 112. By friction between the parts the movement of the mandrel 30 and with it inner sleeve 38 will take with it support 56 and rings 58 and 60 so that support 56 is out from under heads 50 by the time the outer sleeve 40 shoulders out at end 62 against the polished bore receptacle 16. From that point further mandrel 30 movement causes outer sleeve 40 to bump heads 50 and deflect them inwardly now that support 56 has been axially displaced. This is shown in FIG. 6E in close up and the whole assembly in the FIG. 6E position is shown again in FIG. 7.

Those skilled in the art will appreciate that what has been described is a tool with dual modes of operation. The first or preferred mode involves hydraulic system actuation. The hydraulic system sequentially moves an inner sleeve 38 in the same direction to initially unlock a lock by letting dogs 42 drop so as to enable a shear release without actually shearing the ring 66. This sequential movement is accomplished with dual pistons that move together to a travel stop to let the dogs 42 drop and then in another pressure cycle in the hydraulic system which has the effect of disabling the primary piston uses the secondary piston to move the sleeve 38 and even greater distance in the same direction to allow support collet or ring 56 to drop to the mandrel 30 so that a pull on the mandrel 30 results in a flexing of heads 50 and a separation from the polished bore receptacle 16.

Dogs 42 are a lock to prevent loading on shear ring 66 during run in and setting of the packer 10. The shear ring 66 can be used for a backup release in the event the hydraulic system cannot get the support 56 away from the heads 50 for a release from receptacle 16. Here there is available relative movement between the mandrel 30 and the outer sleeve 40 into which the shear ring 66 extends to allow the ring 66 to break but to prevent the sudden release from the breaking of ring 66 to create a slingshot effect that can for example damage an actuator (not shown) that is connected from mandrel 30 to the barrier valve 14. Movement of the mandrel in a first direction that breaks the shear ring 66 and actuates the shock absorber 74 does not remove support 56 from heads 50 so that the tool stays attached to the receptacle 16. Instead the outer sleeve 40 that retains the ring 70 makes the shock absorber 74 actuate until all movement stops. The mandrel 30 has to be moved in the opposite direction to drop the ring 70 out of groove 72 and into mandrel 30 groove 110 so that the mandrel 30 can move up and reposition support 56 away from heads 50 to release from receptacle 16. Further raising of the mandrel 30 shoulders the outer sleeve 40 and uses sleeve 40 to deflect heads 50 inwardly so that the mandrel 30 will come clear of the receptacle 16.

While the invention is described in the form of an anchor with two modes of release the invention is applicable to other downhole tools that operate from a first to a second position and get there in more than one way such as hydraulically and mechanically using a shear release but avoiding the slingshot effect that can damage other parts. The locking feature is enabled for operation and can be defeated to enable a shear release without actually shear releasing. If the hydraulic system fails to release and the locking feature has been earlier disabled then a sequence of opposed mandrel 30 movements will actuate the shear ring breaking and the shock absorber actuating while the tool is still in its initial position. After then setting down weight and picking up there will be a release or a movement of the tool to the second position.

The above description is illustrative of the preferred embodiment and many modifications may be made by those skilled in the art without departing from the invention whose scope is to be determined from the literal and equivalent scope of the claims below:

I claim:

1. A tool for subterranean use, comprising:

a mandrel;

a final controlled element selectively movable between a first and a second position;

a movable member on said mandrel said movable member selectively holding said final controlled element in said first position;

a lock to selectively prevent movement of said mandrel with respect to said final controlled element;

said movable member selectively defeating said lock to enable limited movement of said mandrel to shear a shear member and actuate a shock absorber while retaining said final controlled element in said first position.

2. A tool for subterranean use, comprising:

a mandrel;

a final controlled element selectively movable between a first and a second position;

a movable member on said mandrel said movable member selectively holding said final controlled element in said first position;

a lock to selectively prevent movement of said mandrel with respect to said final controlled element;

said movable member selectively defeating said lock to enable limited movement of said mandrel to shear a shear member and actuate a shock absorber while retaining said final controlled element in said first position;

said movable member comprises an inner sleeve;

said lock selectively securing said mandrel to an outer sleeve of said movable member overlapping said inner sleeve of said movable member, whereupon initial movement of said inner sleeve allows a dog that comprises said lock to exit a groove in said outer sleeve to expose said shear member to stress applied to said mandrel.

3. The tool of claim 2, wherein:

said mandrel selectively retained to said outer sleeve with a shock absorber ring extending into a shock absorber groove in said outer sleeve that is wider than said shock absorber ring so that said mandrel can move, with said dog out of said groove in said outer sleeve, in a first direction relative to said outer sleeve to break said shear member and actuate said shock absorber with said final controlled element remaining in said first position.

4. The tool of claim 3, wherein:

said mandrel is moved in a second direction opposite said first direction after said shock absorber is actuated to allow said shock absorber ring to exit said shock absorber groove in said outer sleeve to allow said mandrel to move sufficiently to enable said final controlled element to go to said second position.

5. The tool of claim 4, wherein:

said inner sleeve is driven by a hydraulic system.

6. The tool of claim 5, wherein:

said movements of said inner sleeve are in the same direction.

7. The tool of claim 6, wherein:

said inner sleeve is driven by a plurality of pistons.

8. The tool of claim 7, wherein:

said plurality of pistons move in tandem for one of said movements while another of said movements is driven by one of said pistons.

9. The tool of claim 3, wherein:

said shock absorber comprises at least one of a crushable ring, a stack of Belleville washers and a fluid in a cavity that is displaced through an orifice.

10. The tool of claim 3, wherein:

said final controlled element comprises a plurality of gripping collets that engage a packer polished bore receptacle in said first position and release from the polished bore receptacle in said second position.

11. A tool for subterranean use, comprising:

a mandrel;

a final controlled element selectively movable between a first and a second position;

a movable member on said mandrel said movable member selectively holding said final controlled element in said first position;

a lock to selectively prevent movement of said mandrel with respect to said final controlled element;

said movable member selectively defeating said lock to enable limited movement of said mandrel to shear a shear member and actuate a shock absorber while retaining said final controlled element in said first position;

said movable member comprises an inner sleeve;

said lock selectively securing said mandrel to an outer sleeve of said movable member overlapping said inner sleeve of said movable member, whereupon initial movement of said inner sleeve allows a dog that comprises said lock to exit a groove in said outer sleeve to expose said shear member to stress applied to said mandrel;

said mandrel selectively retained to said outer sleeve with a shock absorber ring extending into a shock absorber groove in said outer sleeve that is wider than said shock absorber ring so that said mandrel can move, with said dog out of said groove in said outer sleeve, in a first direction relative to said outer sleeve to break said shear member and actuate said shock absorber with said final controlled element remaining in said first position;

said mandrel is moved in a second direction opposite said first direction after said shock absorber is actuated to allow said shock absorber ring to exit said shock absorber groove in said outer sleeve to allow said mandrel to move sufficiently to enable said final controlled element to go to said second position;

said inner sleeve is driven by a hydraulic system;

said movements of said inner sleeve are in the same direction;

said inner sleeve is driven by a plurality of pistons;

said plurality of pistons move in tandem for one of said movements while another of said movements is driven by one of said pistons;

said plurality of pistons comprise a primary and a secondary annular piston;

said primary piston comprises a travel stop;

said lock is defeated when said primary piston travel stop engages said mandrel.

12. The tool of claim 11, wherein:

said primary piston drives said secondary piston against said inner sleeve in a first direction when said hydraulic system is pressurized until said stop is engaged by said mandrel.

13. The tool of claim 12, wherein:

said mandrel further comprises a biased return member that contacts said primary piston for movement of said primary piston in a second direction opposite said first direction.

14. The tool of claim 13, wherein:

said return member moving said primary piston in said second direction after said primary piston has moved in said first direction and pressure is removed from said hydraulic system.

15. The tool of claim 14, wherein:

said return member moving said primary piston to a location where it is disabled from further movement in said first direction with said hydraulic system.

16. The tool of claim 14, wherein:

movement of said primary piston in said second direction by said return member also induces movement of said secondary piston in said second direction due to liquid locking of said secondary piston to said primary piston during at least a portion of said movement in said second direction.

17. The tool of claim 14, wherein:

said hydraulic system moving said secondary piston in said first direction with said primary piston disabled from movement to shift said inner sleeve to enable movement of said final controlled element to said second position.

* * * * *